United States Patent [19]

Vickers et al.

[11] Patent Number: 4,591,289

[45] Date of Patent: May 27, 1986

[54] ATTACHING DEVICE FOR MODULAR FURNITURE

[75] Inventors: Timothy J. Vickers, Boone; Darrell W. Lloyd, Lenoir, both of N.C.

[73] Assignee: Bernhardt Industries, Lenoir, N.C.

[21] Appl. No.: 524,075

[22] Filed: Aug. 17, 1983

[51] Int. Cl.[4] ..... F16B 21/00; A47C 15/00; E05C 19/14

[52] U.S. Cl. ..... 403/322; 403/330; 297/248; 292/247; 292/249; 292/271; 108/64

[58] Field of Search ..... 297/248, 249; 403/330, 403/321, 322; 292/246, 248, 249, 247, 250, 271, 265, 266, 213; 108/64; 248/639

[56] References Cited

U.S. PATENT DOCUMENTS

| | | | |
|---|---|---|---|
| 118,081 | 8/1871 | Webb | 403/322 |
| 735,618 | 8/1903 | Tannewitz | 403/321 |
| 834,461 | 10/1906 | Fair | 292/247 |
| 1,469,196 | 9/1923 | Strange | 292/246 |
| 1,747,707 | 2/1930 | Grosse | 292/271 |
| 1,879,673 | 9/1932 | Fischer | 297/248 |

FOREIGN PATENT DOCUMENTS

| | | | |
|---|---|---|---|
| 302004 | 8/1916 | Fed. Rep. of Germany | 297/248 |
| 2100121 | 12/1982 | United Kingdom | 108/64 |

*Primary Examiner*—Cornelius J. Husar
*Assistant Examiner*—Peter M. Cuomo
*Attorney, Agent, or Firm*—Cushman, Darby & Cushman

[57] ABSTRACT

A latch arrangement for latching one furniture component to another in side-by-side abutting relationship includes a horizontal crank arm attached to the underside of one component and a hook attached to the underside of the other component in a position to be engaged by the crank portion of the crank arm or by a link pivotally carried by the crank arm. In operation the crank arm is rotated about its axis, by means of a removable handle, first in one direction to extend the crank portion of the arm laterally of its respective furniture component so as to be engageable with the hook and then in the opposite direction to draw the components together. Both the hook and the crank portion of the crank arm are arranged to lie wholly underneath their respective furniture components when not in use, so as to be concealed from view. In the construction in which the crank portion directly engages the hook, the latter is arranged to move in a vertical plane to accommodate the vertical component of movement of the crank portion of the crank arm during rotation of the crank arm toward its latching position.

6 Claims, 8 Drawing Figures

ATTACHING DEVICE FOR MODULAR FURNITURE

This invention relates to a latching or ganging device for drawing two furniture components into side-by-side engagement and for holding the components in that position, the device including a first part, such as a hook, carried by one component and engageable with a second part, such as a crank arm, carried by the other component.

BACKGROUND

Latching or ganging devices of the kind broadly referred to above are known. Typically they are used to releasably latch together furniture modules, such as the components of a sectional sofa or the like, so that the components can be disconnected from each other, and reconnected in a different arrangement. The principles apply of course to a variety of furniture modules. Examples of such devices are disclosed in U.S. Pat. Nos. 1,879,673, 2,751,969 and 2,904,101. U.S. Pat. No. 1,879,673 is of particular interest in that it discloses a rotatable crank carried on the underside of one furniture component and having a crank or yoke portion which, upon rotation of the crank arm, projects laterally beyond the respective furniture component and engages a fixed lug carried on the underside of another furniture component.

SUMMARY OF THE INVENTION

The furniture-component latch arrangement of the present invention is a crank arm and hook type arrangement which differs in several important respects from prior furniture-component latch arrangements. The hook, which is mounted on one component, is adjustable, as by being swingable about its attachment screw, between a concealed position below its component and an extended visible position in which it resides laterally outward of its component. The crank portion or yoke of the crank arm is also positionable, upon rotation of the arm in opposite directions, between a concealed position and a laterally extended visible position. In operation the hook and crank portions are maneuvered to their extended positions, and the hook is manually engaged with the crank portion either directly or via an intermediate link, the furniture components being manually shifted along the floor as necessary. The crank arm is then manually rotated in an opposite direction in order to draw the furniture components together into abutting relationship.

In the preferred construction the crank arm is rotated by means of a removable handle which releasably connects with one end of the crank arm at a concealed location inward of the adjacent edge of the furniture component. Upon removal of the handle the connection point is not visible. The absence of a permanent fixed handle allows attachment of the furniture component to other components in a variety of configurations.

Also in the preferred construction the hook is further adjustable longitudinally of itself toward and away from the adjacent edge of its furniture component to compensate for variations in the thickness of the fabric or padding of the components being latched together.

By arranging the hook and crank portion to be extendable to positions visible to the operator when manually engaging the two, a very convenient and easy-to-operate system is provided. This feature, together with the adjustability of the hook and the removable handle feature, render the system very versatile in that a variety of different furniture components can be latched in a variety of configurations.

BRIEF DESCRIPTION OF THE DRAWINGS

FIGS. 1*a*, 1*b* and 1*c* schematically illustrate two furniture components, in inverted positions, with a latch arrangement comprising a hook 10 mounted on the underside of one component 12 and a crank arm 14 mounted for rotation about its axis on the underside of the other component 16. The hook 10 is mounted near an edge 18 of its respective furniture component 12 by an attaching means which permits the hook 10 to move between a concealed position wholly underneath the furniture component 12 (FIG. 1*a*) and an extended position in which its open, operating end 20 resides laterally of the edge 18 of the furniture component 12 (FIGS. 1*b* and 1*c*). The attaching means may be a screw 21 (FIGS. 3, 4 and 5) passing through the other end of the hook 10 and into the frame of the furniture component 12 so that the hook 10 can swing in a horizontal plane as indicated by the arrows in FIG. 1*a*. The open, operating end 20 of the hook is designed to receive a crank portion 22 of the crank arm 14. A convenient shape for the end 20 is a channel-shaped slot or groove 24, as seen in FIGS. 3, 4 and 5, this slot 24 in the illustrated embodiment being located above the body of the hook 10 (when the furniture components 12, 16 are in their normal positions) and facing toward the respective component 12.

Figure 1A:
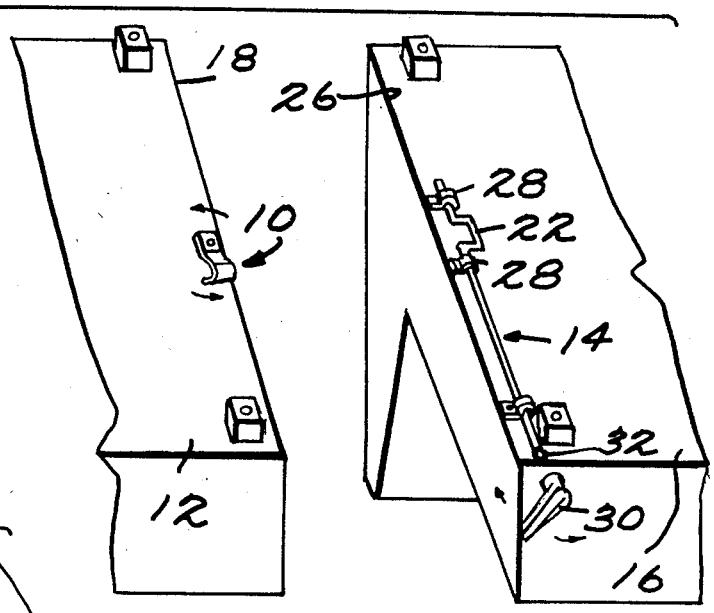
FIG. 1*a* is a schematic perspective view of two furniture components, in inverted positions, showing a latch arrangement secured to the undersurfaces of the furniture components, with the parts of the latch arrangement in their concealed, unlatched positions.

The crank arm 14 is mounted near and parallel to an edge 26 of its furniture component 16 by any convenient mounting means, such as spaced apart U-shaped brackets 28, which permits the arm 14 to rotate about its axis. It is desired that the arm 14 be hidden from view as much as is possible and to this end it is located essentially flush with the underside of the furniture component 16. Rotation of the arm 14 is effected manually with a lever-type handle 30 which preferably is removably attachable to an end 32 of the arm 14, this end 32 being concealed from view by being located inwardly of the adjacent edge 34 of the furniture component 16. The coupling between the end 32 and the handle 30 may take any convenient form, such as a bolt head having a hex socket fixed to the end 32, the handle 30 being a conventional right-angle hex key.

Figure 1B:
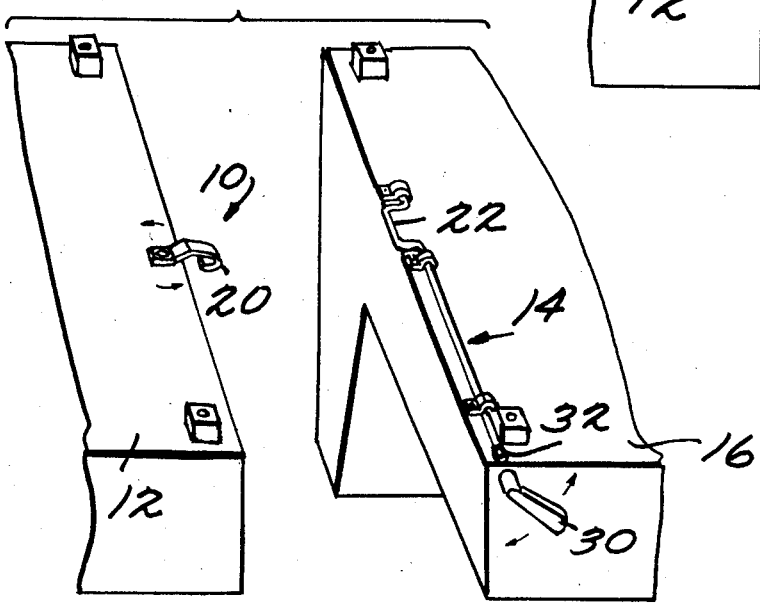
FIG. 1*b* is a schematic view similar to FIG. 1, with the parts of the latch arrangement about to be engaged with each other.

The crank arm 14 includes the aforementioned crank portion 22 which in one rotative position of the arm 14 (FIG. 1*a*) is concealed from view in that it is positioned inwardly of the straight portion of the arm and generally parallel to and generally in contact with the underside of the furniture component 16. The arm 14 is so located relative to the edge 26 of the component 16 that when the arm 14 is rotated through approximately 180° in a direction to swing the crank portion 22 first downwardly and then upwardly, the crank portion 22 moves to a position laterally outward of the edge 26 of the furniture component. In this position it is engageable with the open end 20 of the hook 10, as seen in FIG. 1*b*. The crank portion 22 can then be manually inserted into the groove 24 in the end 20 of the hook 10. Subsequent rotation of the arm 14 about 180° in the opposite direction pulls the two furniture components 14 and 16 together as seen in FIG. 1*b*.

While only a single hook 10 and a single crank 22 are illustrated, it is clear that the crank arm 14 may have more than one crank portion 22 and that plural hooks 10 may be provided.

Figure 1C:
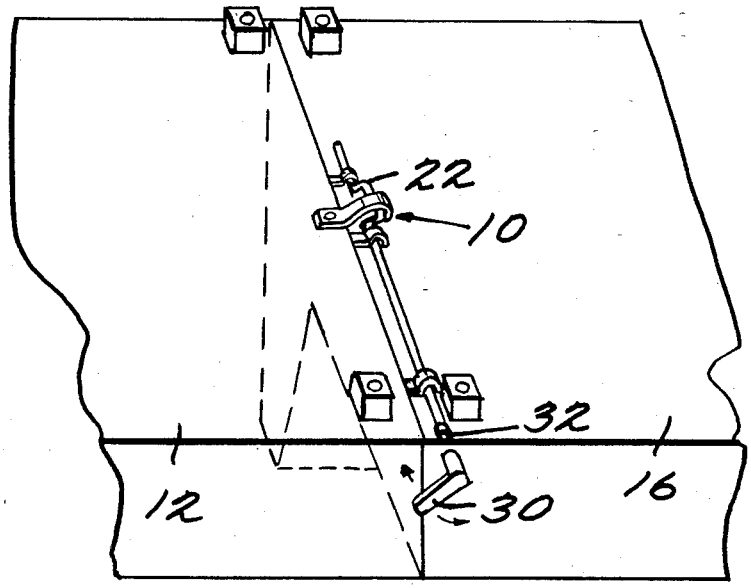
FIG. 1*c* is a schematic view similar to FIG. 1, with the parts of the latch arrangement in their latched positions.
Figure 2:
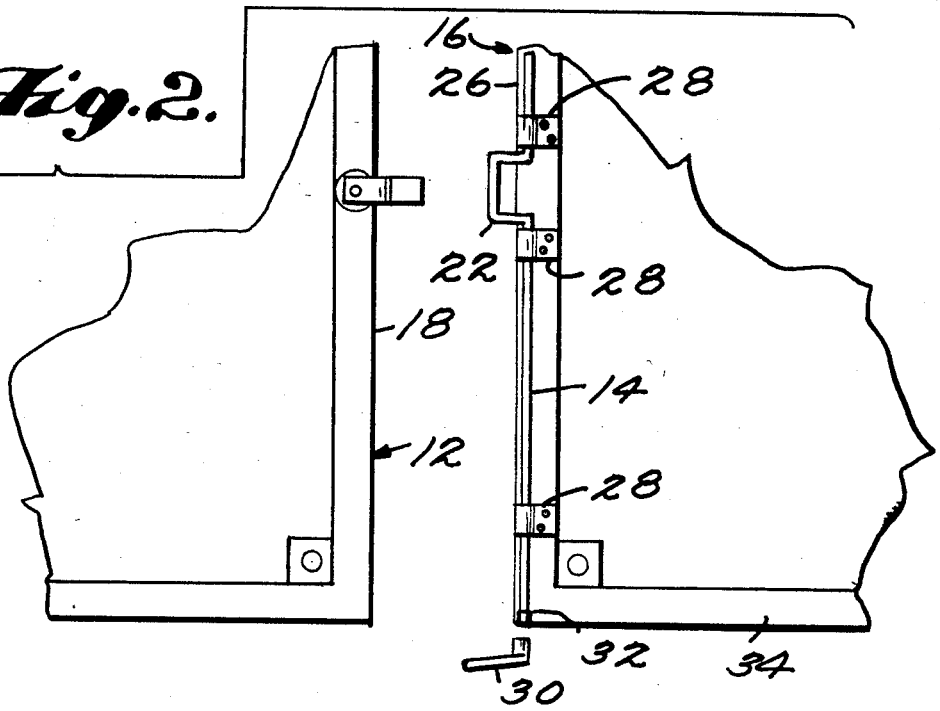
FIG. 2 is a more detailed view of the latch arrangement with the parts in the same position as shown in FIG. 1*b;*
Figure 3:
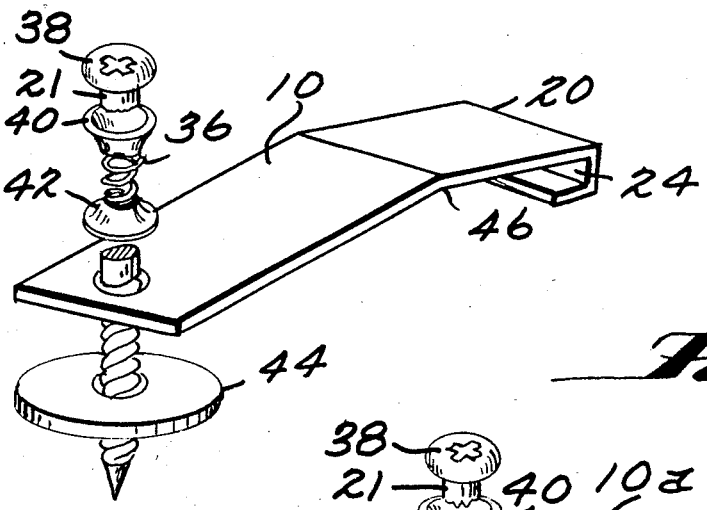
FIG. 3 is a perspective view of a hook assembly.

FIG. 3 illustrates the hook 10 in greater detail. In order to accommodate the vertical component of motion of the crank portion 22 of the crank arm 14 when the latter swings from its FIG. 1*b* position to its FIG. 1*c* position, the hook 10 is mounted so that its open end 20 can move vertically as the crank portion 22 swings. This is accomplished by allowing the hook 10 to swing in a vertical plane about an axis located at or near the end opposite the open end 20. This movement can be provided for simply by not tightly clamping the hook 10 to the furniture component 12 with the screw 21. Unwanted free swinging both vertically and horizontally is prevented by inserting a helical compression spring 36 between the body of the hook 10 and the head 38 of the screw 21. The desired swinging movements are made smoother by providing two cup-shaped washers 40 and 42 at opposite ends of the spring 36, with the convex surfaces of the washers in contact with the spring 36. It is desirable also to include a flat washer 44 between the hook 10 and the undersurface of the furniture component to provide a bearing surface for the swinging movements of the hook 10.

The body of the hook 10 between its ends includes a transverse bend 46 such that in the normal position of the furniture components 12, 16 the body of the hook is somewhat concave upwardly. This shape allows the crank portion 22 of the crank arm 14 to swing past its point of maximum tension during a latching operation.

Figure 4:
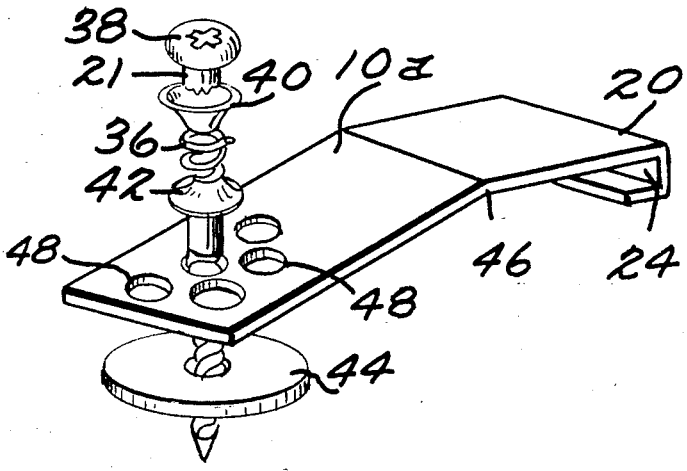
FIG. 4 is a perspective view of a second embodiment of a hook assembly.

FIG. 4 illustrates an embodiment of a hook 10*a* which is adjustably mountable on its furniture component so as to compensate for differences in fabric or padding thickness which result in differences in spacing between the frameworks of adjacent furniture components when the components are in contact with each other. In the FIG. 4 embodiment this adjustment is obtained by providing a row of screw holes 48 spaced apart along the longitudinal axis of the hook 10*a*. More than one row, with the holes in one row offset with respect to the holes in an adjacent row, will provide a greater number of hook positions. The screw, washers and spring have been omitted from FIG. 4 for simplicity of illustration.

Figure 5:
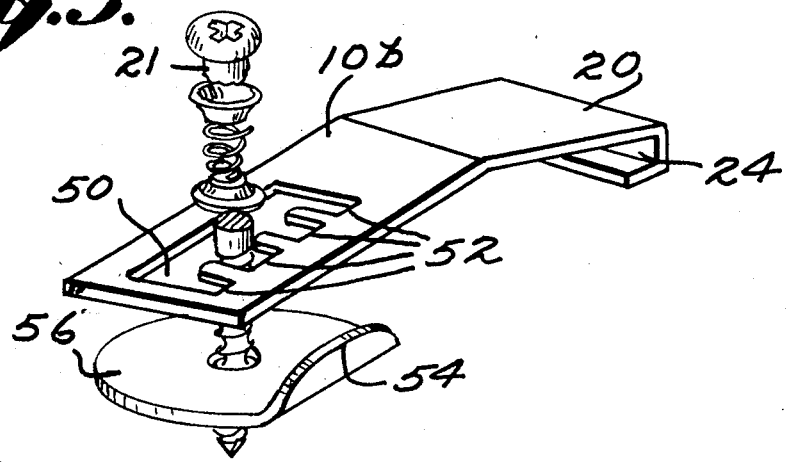
FIG. 5 is a perspective view of a third embodiment of a hook assembly.

FIG. 5 illustrates an embodiment of a hook 10*b* which can be adjusted longitudinally without removing the screw 21. The body of the hook 10*b* has a longitudinal slot 50 therein so that the hook 10*b* can slide longitudinally relative to the screw 21.

One edge of the slot 50 has a series of notches 52 in each of which the screw 21 can engage to fix the longitudinal position of the hook 10*b*. The screw 21 is held in any one of the notches 52 by a right-angle lip 54 on a washer 56 positioned between the hook 10*b* and its furniture component, the lip 54 engaging the side edge of the hook 10*b* and thereby holding the respective notch 52 in engagement with the screw 21. To release the notch 52 from the screw 21 the hook 10*b* is manually twisted about the axis of the screw 21 thereby overriding the lip 54 so that the edges of the notch 52 are no longer held in contact with the screw 21 by the vertical surface of the lip 54. The hook 10 can then be moved longitudinally of itself to position another of the notches 52 adjacent the screw 21. Subsequent twisting of the hook 10*b* in the opposite direction about the axis of the screw 21 brings the edge of the hook 10*b* into parallelism with the vertical surface of the lip 54, and the spring 36 then forces the hook 10*b* toward the body of the washer 56 so that the hook 10*b* is prevented from rotation by the lip 54.

Figure 6:
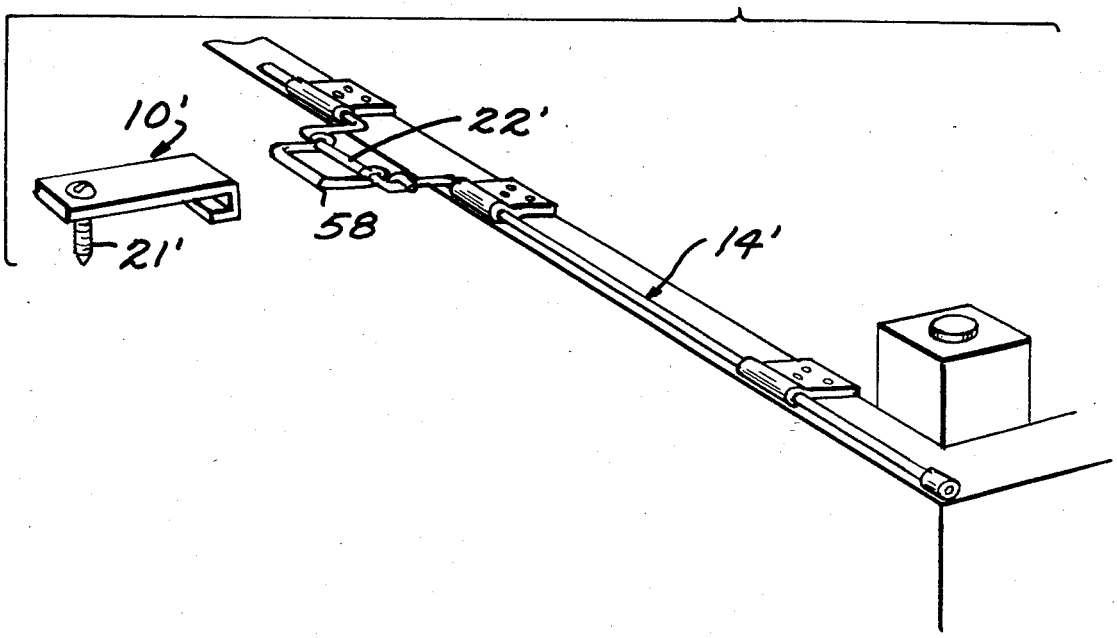
FIG. 6 is a perspective view of a second embodiment of a crank arm assembly.

FIG. 6 illustrates a modified crank arm assembly in whioh an intermediate pivoted link 58 is provided between the crank portion 22' of the crank arm 14' and the respective hook 10', rather than having the crank portion 22' directly engageable with the hook 10' as in the construction of FIGS. 1–5. The link 58 compensates for the vertical component of movement of the crank portion 22' during a latching operation. Therefore the hook 10' need not be pivotable in a vertical plane as in FIGS. 4, 5 and 6, and the spring 36 and washers 40, 42 can be omitted. The hook 10' should, however, be swingable about the axis of its attaching screw 21' between a concealed position wholly underneath its furniture component and a laterally extended position in which it is visible and can be manually engaged with the crank arm assembly.

The link 58 is conveniently of square U-shape with the free ends of the legs of the U being connected to the crank portion 22' for swinging movement about that portion. The body of the U is insertable into the open end 20' of the hook 10'.

Operation

The operation of the system of FIGS. 1–5 is as follows, assuming that the parts are in the position shown in FIG. 1*a*, except that the furniture components 12 and 16 have been righted so as to rest on the floor in their normal positions. All of the parts of the latching arrangement are essentially out of sight at this time, because the hook 10 has been previously swung about its attaching screw 21 to a position wholly underneath the underside of the furniture component 12 and because the crank arm 14 has been previously rotated to position the crank portion 22 wholly underneath the furniture component 12. The hook 10 is now manually rotated about the attaching screw 21 so as to project laterally outward. The removable handle 30 is fitted to the end 32 of the crank arm 14 and manually twisted to rotate the crank arm 14 in an appropriate direction to swing the crank portion 22 first downwardly and then upwardly to a position laterally beyond the furniture component 16. The hook 10 and crank portion 22 are now unconcealed, as is evident from FIG. 1*b*. The furniture components 12 and 16 if not already adjacent each other are moved to be adjacent and one or the other of the components is maneuvered as necessary so that the hook 10 can be manually engaged with the crank portion 22. Turning torque in an opposite direction is then manually applied to the handle 30 sufficient to draw the two components 12 and 16 into engagement with each other and torque is continued until the crank portion 22 reaches its locking plane. This position will be evident by feel when the crank portion 22 overrides its point of maximum tension with the hook 10, the bend 46 in the hook allowing such override, the crank portion 22 then coming into contact with the underside of the component 16 which acts as a stop. As described above the hook 10 accommodates the vertical component of movement of the crank portion 22 by pivoting in a vertical plane against the bias force of the spring 36. The handle 30 is then removed from the crank arm 14, leaving an essentially invisible conjunction between the components 12 and 16. When the components are to be unlatched from each other, the above-described procedure is carried out in reverse.

The operation of the FIG. 6 system is essentially the same as that described above, except that the hook 10′ is manually engaged with the link 58 carried by the crank portion 22′ rather than directly with the crank portion 22′. As previously described the hook 10′ need not pivot in a vertical plane during a latching operation, because the vertical component of movement of the crank portion 22′ is accommodated by swinging movement of the link 58 about the crank portion.

Additional furniture components can of course be added to the illustrated two-component group, by providing the necessary additional latching assemblies. The components can also be latched together in other arrangements by providing the latching assemblies along other edges of the components.

What is claimed is:

1. A latch arrangement for latching one furniture component to another in adjacent abutting relationship comprising: a horizontal crank arm rotatable about its axis carried on the underside of one furniture component, said arm having a crank portion projecting outwardly from the rotation axis and said arm being located such that in a first rotational position of the arm the crank portion lies wholly underneath its respective furniture component and in a second rotational position of the arm the crank portion lies laterally of its respective furniture component; and an engageable hook carried by the underside of the other furniture component, means mounting said hook on said other furniture component for movement between a position concealed below said component and another position projecting laterally of said other furniture component, the arrangement being such that in moving from its second position to its first position said crank portion swings first downwardly and then upwardly thereby being capable of applying a pulling force to said hook.

2. A latch arrangement as in claim 1 wherein said crank portion is arranged to directly engage said hook in swinging from its second position toward its first position, said arrangement including means mounting said hook for movement in a vertical plane to accommodate the vertical component of the swinging movement of said crank portion.

3. A latch arrangement as in claim 1 including an intermediate swingable link between said hook and said crank portion for accommodating the vertical component of swinging movement of said crank portion.

4. A latch arrangement as in claim 3 wherein said link is a U-shaped link having legs pivoted to said crank portion and having a body directly engageable with said hook.

5. A latch arrangement as in claim 1 wherein the position of said hook is adjustable in a horizontal plane to permit plural extended positions.

6. A latch arrangement as in claim 1 wherein said mounting means for said hook permits swinging movement of said hook between its concealed position and its projecting position.

* * * * *